United States Patent [19]

Noda

[11] 3,992,758

[45] Nov. 23, 1976

[54] CLIP

[75] Inventor: Taizo Noda, Nishinomiya, Japan

[73] Assignee: Kohshoh Limited, Kyoto, Japan

[22] Filed: Apr. 23, 1976

[21] Appl. No.: 679,574

[52] U.S. Cl. ..... 24/251; 24/248 R

[51] Int. Cl.[2] ..... A44B 21/00

[58] Field of Search ..... 24/251, 260, 205.15, 24/248 R

[56] References Cited

UNITED STATES PATENTS

| | | | |
|---|---|---|---|
| 1,634,532 | 7/1927 | Bowe | 24/251 |
| 2,228,360 | 1/1941 | Nordeck | 24/251 |
| 3,014,258 | 12/1961 | Pearl | 24/251 |

*Primary Examiner*—Paul R. Gilliam
*Assistant Examiner*—Alex Grosz

[57] ABSTRACT

A clip comprises a lower member including a base plate, at least one bridge and at least one pivot projection, an upper member including a base plate and at least one recessed bearing portion positioned to receive the pivot projection, thereby permitting pivotal connection of the upper and lower members, and a slide member including at least one slide plate and at least one crossplate having an upper surface capable of slidably engaging with the underside of an elongated portion of the bridge. Either one or both of the upper and lower members are selectively reduced in thickness toward its rear edge so as to obtain a desired angle of opening of the clip.

6 Claims, 12 Drawing Figures

CLIP

The present invention relates to a clip, and more particularly to a clip attached to the end of a suspender, a tie-pin, a clothes-pin and other similar clips.

Heretofore, various clips of this type have been proposed. These conventional clips generally comprise a pair of plate members which are provided with a pivot forming section respectively, in which a pin is inserted with its ends caulked so as to permit a pivotal connection of the two plate members. Further, between the two plate members are mounted a spring and a lever by which the front ends of the plate members can be kept either in open or closed positions. However, since clips of this type are of comparatively small size, the work of mounting a shaft for pivotal connection of the plate members and mounting the spring and lever therebetween is accompanied by practical difficulties, which has been a large problem in manufacturing clips of this type.

After a large number of studies in view of these points, the inventor has succeeded in obtaining a clip which eliminates the disadvantages of the conventional clips.

It is an object of the present invention to provide an improved clip.

It is another object of the present invention to provide a novel construction which provides a pivotal connection of members in a clip.

It is a further object of the present invention to provide a clip which is extremely easy to manufacture and assemble.

It is still another object of the present invention to provide a clip the opening and closing operations of which can be extremely easily performed.

It is still another object of the present invention to provide a clip capable of clipping a thing to be clipped securely and effectively.

It is still another object of the present invention to provide a clip which comprises a lower member including a base plate, at least one bridge consisting of two legs protruding beyond said base plate and formed integrally therewith and an elongated portion extending between said two legs, and at least one pivot projection formed integrally with said base plate and positioned at the rear portion thereof; an upper member including a base plate and at least one bearing portion formed integrally with said base plate and positioned to receive said pivot projection; and a slide member including at least one slide plate and at least one crossplate formed integrally with said slide plate so as to slidably engage with the underside of said elongated portion of said bridge; at least one of the opposite rear end portions of said upper and lower members being gradually reduced in thickness toward its rear edge so that clipping sections may be kept in open position at a desired angle.

These and other objects of the present invention will be understood from the detailed description of embodiments by referring to the accompanying drawings, in which.

Figure 1:
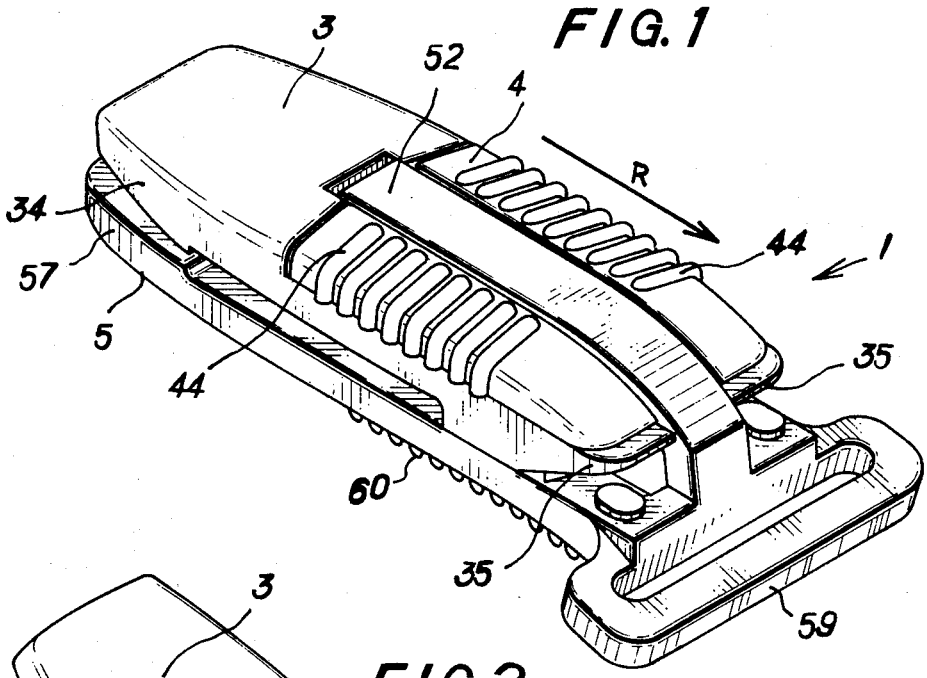
FIG. 1 is a perspective view of an embodiment of a clip according to the present invention in closed position.

Referring now to FIGS. 1 to 5, a clip 1 according to the present invention comprises a lower member 5 includng a base plate 51, a bridge 52 and pivot projections 56 which are formed integrally, an upper member 3 including a base plate 31, a cutaway portion 32 and bearing portions 33 which are integrally formed, and a slide member 4 including two slide plates 41 and a crossplate 42 which are integrally formed with each other. The materials of said upper, lower and slide members 3, 4, 5 are not particularly limited and can be selected from metals, various resins or the like. It is desirable, however, that these members are formed from materials having high elastic properties, e.g. resins such as polycarbonate, ABS or the like which are extremely superior in strength. In particular, said lower member 5 is most desirably formed from these materials. The bridge 52 comprises two legs 53, 54 upwardly protruding beyond the base plate 51 and arranged in a longitudinal center line of the substantially rear half portion thereof, and an elongated portion 55 extending between said two legs 53, 54, which legs 53, 54 are disposed at the rear portion of the base plate 51 and at the substantially middle portion of the same respectively. Said elongated portion 55 is preferably formed so as to become thicker from its rear edge, i.e., the leg 53 toward its front edge, i.e., the leg 54. The leg 53 may be disposed at the rear end of the base plate 51. The pivot projections 56, which are integrally formed with the base plate 51 and disposed at the rear portion thereof, are adapted to be fitted into the bearing portions 33 of the base plate 31 of the upper member 3 to effect pivoting of the upper member 3. Preferably the pivot projections 56 are disposed inside the both of the side edges of the base plate 51 so that they are hidden from view. The base plate 51 is further provided at its front end portion with a clipping section 57, which is provided on its upper surface with a plurality of projections, which is formed integrally with the base plate 51, and with which a further clipping section 34 disposed at the front end of the base plate 31 of the upper member 3 and provided with a plurality of projections cooperates to prevent slippage of a thing to be clipped. Located behind the base plate 51 is a band-fitting portion 59 for connecting one end of a band or the like with the clip 1. Said band-fitting portion 59 is also formed integrally with the base plate 51.

The upper member 3 is cut away at 32 for loose insertion of the bridge 52. The base plate 31 of the upper member 3 is provided on its lower surface with said recessed bearing portions 33, which are positioned to receive said pivot projections 56 of the lower member 5, thereby effecting pivoting of the upper member 3. Preferably said recessed bearing portions 33 are disposed inside the both of the side edges of the base plate 31 so that they are hidden from view. Furthermore, the base plate 31 is provided at its front end portion with the clipping section 34 which is provided on its lower surface with a plurality of projections, and which is formed integrally with the base plate 31. Said clipping section 34 cooperates with the further clipping section 57 of the base plate 51 to prevent slippage of a thing to be clipped.

The two slide plates 41 of the slide member 4 of the clip 1 has a lower surface which is adequate to slidably engage with the upper surface of the upper member 3. The crossplate 42 of the slide member 4, connecting the two slide plates 41, has an upper surface capable of slidably engaging with the underside of the elongated portion 55 of said bridge 52. The crossplate 42 may be constituted so that its upper surface be in the same plane with each upper surface of the slide plates 41. It is preferable, however, that the slide plates 41 protrude beyond the crossplate 42 by a predetermined distance in such a manner as to prevent dislodgement of the slide member 4, and so as to make easier sliding movement of the slide member 4.

Figure 3:
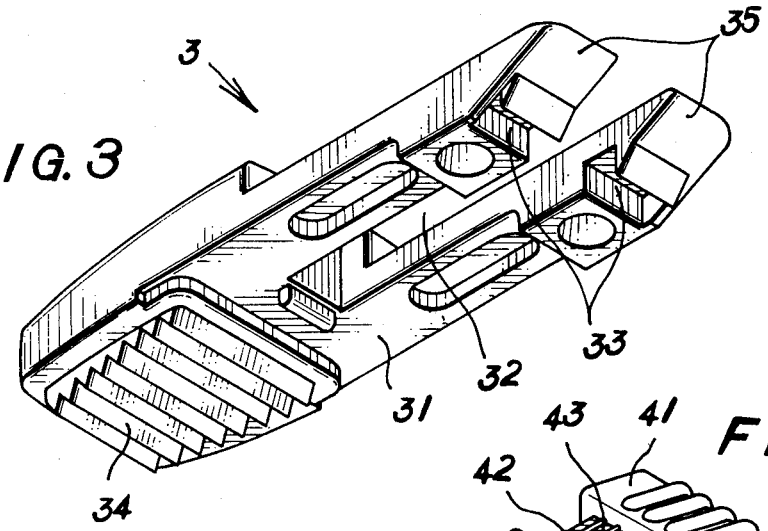
FIG. 3 is a perspective view of an upper member of the clip of FIG. 1.
Figure 4:
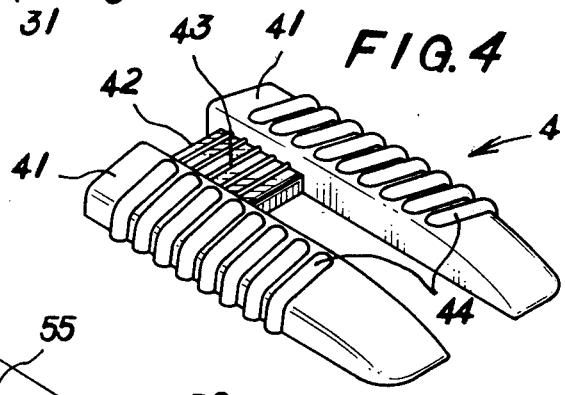
FIG. 4 is a perspective view of a slide member of the clip of FIG. 1.
Figure 5:
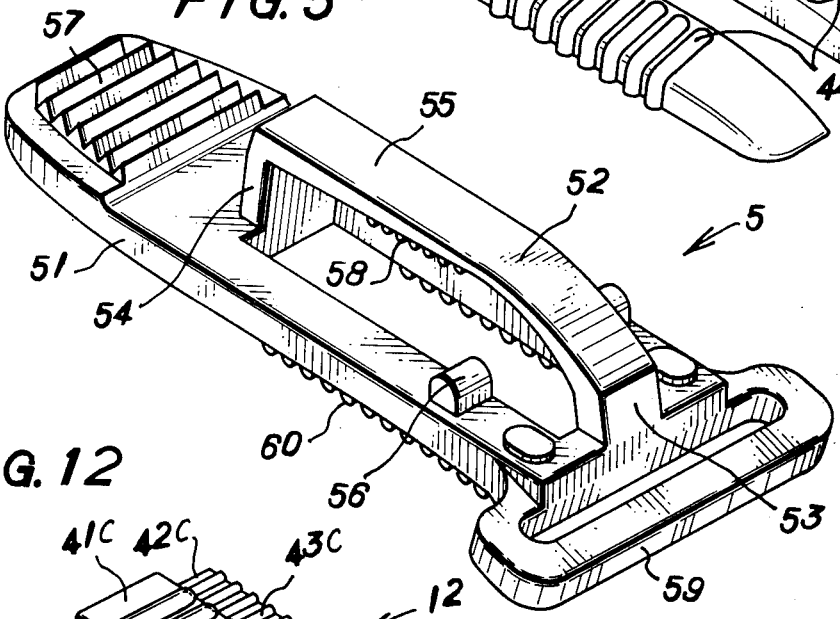
FIG. 5 is a perspective view of a lower member of the clip of FIG. 1.

The pivot projection 56 of the lower member 5 may be replaced by a recessed bearing portion, whereupon the recessed bearing portion 33 of the upper member 3 naturally have to be replaced by a corresponding pivot projection. As mentioned above, both of the clipping section 34, 57 are provided with a plurality of projections, and those on one or both of the clipping sections 34, 57 may be formed from resilient materials such as rubber. Furthermore, at least one of the upper and lower members 3, 5 of the clip 1 is formed so that its rear end portion opposite to the other member becomes thinner from the bearing portions 33 or from the pivot projections 56 toward its rear edge, thereby permitting the clip 1 to be kept in open position at a desired angle. To this end, in the clip 1, the upper member 3 is provided with gradually reduced portions 35 as best seen in FIG. 3. The thickness of said gradually reduced portions 35 can be determined arbitrarily so that a thing, thick or thin, may be clipped in a desired manner. The crossplate 42 of the slide member 4 is provided on its upper surface with integrally formed projections 43, while the elongated portion 55 of the lower member 5 is provided on its lower surface with integrally formed projections 58, the former projections 43 cooperating with the latter projections 58 to prevent the slide member 4 from slipping and thereby to permit even a thick thing to be securely clipped. Furthermore, the slide plates 41 of the slide member 4 are provided on their upper surfaces with desirably laterally-elongated projections 44, which are formed integrally with the corresponding slide plate 41, while the base plate 51 of the lower member 5 is provided on its lower surface with desirably laterally-elongated projections 60, which are also formed integrally with the base plate 51. These projections 44, 60 are adapted to provide an anti-slipping effect and thereby to facilitate performing the opening and closing operations of the clip 1 by hand.

Figure 2:
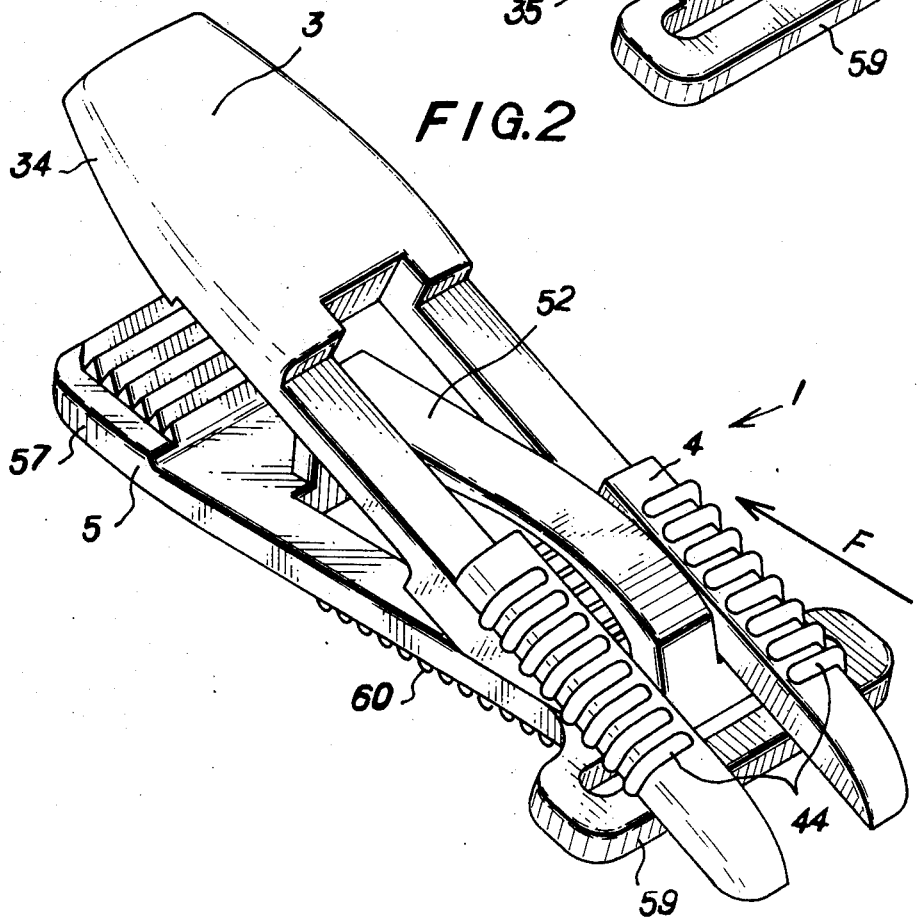
FIG. 2 is a perspective view of the clip of FIG. 1 in open position.

The manner of operation of the clip 1 according to the present invention will be explained below. The slide member 4 is brought into a position shown in FIG. 1. Subsequent to sliding the slide member 4 in the direction of arrow R, the gradually reduced portions 35 are pressed downwardly by means of the slide member 4 to effect the opening of the clipping sections 34, 57 of upper and lower members 3, 5, as shown in FIG. 2. Then, the slide member 4 in the position shown in FIG. 2 is slid in the direction of arrow F so that downward pressure of the slide member 4 against the gradually reduced portions 35 is caused to gradually decrease, and on the contrary a force is applied gradually which downwardly presses the clipping section 34 of the upper member 3. As the result of this downward pivotal movement of the clipping section 34, the clipping sections 34, 57 of the both members 3, 5 are again brought into closed position.

As mentioned above, the clip 1 according to the present invention has a simple construction without the need of a spring, a lever and a pin which is usually indispensable for pivotal connection, thereby facilitating to manufacture and assemble the same and permitting achievement of abovementioned objects. Furthermore, it is possible to perform the opening and closing operations of the clip 1 by one hand, since the clip 1 is not provided with a lever, thereby providing an excellent appearance.

Another embodiment of a clip according to the present invention will be described below.

Referring to FIGS. 6 to 10, the same reference numerals as used relative to said clip 1 but with annexation a will refer to portions common to both embodiments in function. Therefore, detailed description will be omitted for portions designated by the same reference numerals, since they function or are adapted to function in the same manner as in the first embodiment. Therefore, the clip 6 comprises a lower member 10 including integrally formed one base plate **51*a*, two bridges 52*a* and one pivot projection 56*a*, an upper member 8 including integrally formed one base plate 31*a* and one bearing portion 33*a*, and a slide member 9 including integrally formed one slide plate 41*a* and two crossplates 42*a*. Said members 8, 9, 10, as a matter of course, are formed from the same materials as referred to in the description of the clip 1. Furthermore, each bridge 52*a* comprises longitudinally spaced two legs 53*a*, 54*a* each upwardly protruding beyond the side portion of the substantially rear half of the base plate 51*a*, and an elongated portion 55*a* extending between said two legs 53*a*, 54*a* and having a thickness gradually increased from the leg 53*a* toward the leg 54*a*. The leg 54*a* is disposed substantially at the middle length of the base plate 51*a* while the leg 53*a* at the rear portion of the base plate 51*a*. The leg 53*a* may be disposed particularly at the rear end of the base plate 51*a*. On the longitudinal center line in the rear portion of the upper surface of the base plate 51*a* of the lower member 10, there is provided a pivot projection 56*a* which is formed integrally with the base plate 51*a* and adapted to cooperate with the bearing portion 33*a* provided on the base plate 31*a* of the upper member so as to permit pivotal movement. The base plate 51*a* is further provided at its front portion with an integrally formed clipping section 57*a* having projections on its upper surface. Located behind the base plate 51*a* is a band-fitting portion 59,** which is formed integrally therewith.

The rear portion of the base plate 31*a* of the upper member 8 is smaller in width than the clipping section 34*a* in the front portion thereof and adapted to be loosely inserted between said two bridges 52*a*. The base plate 31*a* is further provided at the rear portion of the lower surface thereof with an integrally formed recessed bearing portion 33*a* adapted to receive and cooperate with the pivot projection 56*a* of the lower member 10 to permit a pivotal movement. The base plate 31*a* is further provided at its front portion with an integrally formed clipping section 34*a* having projections on its lower surface.

The slide plate 41*a* of the slide member 9 has a lower surface capable of slidably engaging with the upper surface of the upper member 8, while the two crossplates 42*a* are protruded beyond both sides of the slide plate 41*a* and each has an upper surface capable of slidably engaging with the corresponding lower surface of the elongated portion 55*a* of the bridge 52*a*. The crossplates 42*a* may be constituted so that their upper surfaces be in the same plane with the upper surface of the slide plate 41*a*. It is preferable, however, that the slide plate 41*a* protrude beyond the crossplates 42*a* by a predetermined distance in such a manner as to prevent dislodgement of the slide member 9, and so as to make easier sliding movement of the slide member 9.

The pivot projection 56*a* of the lower member 10 may be replaced by a recessed bearing portion, whereupon the recessed bearing portion 33*a* of the upper member 8 naturally have to be replaced by a/corresponding pivot projection. The upper member 8 is provided at its rear end with a portion 35*a* gradually reduced in thickness thereof so as to obtain a desired angle of opening of the clip 6. The slide member 9 is provided with projections 43*a*, 44*a* while the lower member 10 with projections 58*a*, 60*a* for preventing slippage, similarly to the case of the clip 1.

Further, the operation of this clip 6 is entirely the same with that of the clip 1.

Consequently, it is apparent that this clip 6 provides the same advantages as the clip 1.

A modification of the slide member 4 of the clip 1 according to the present invention will be now described below.

Figure 11:
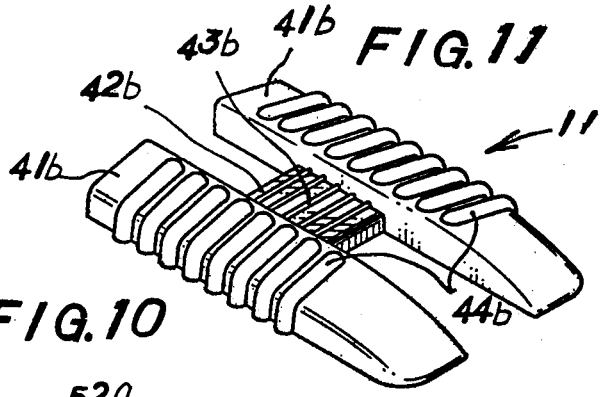
FIG. 11 is a perspective view of a modified embodiment of a slide member of the clip of FIG. 1.
Figure 10:
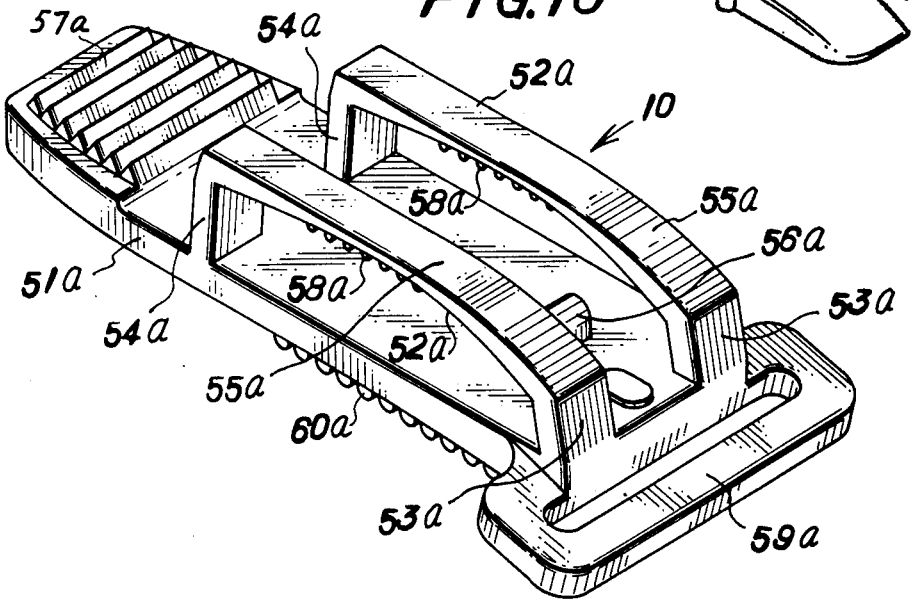
FIG. 10 is a perspective view of a lower member of the clip of FIG. 6.

Referring to FIG. 11, the same reference numerals as used relative to the slide member 4 but with annexation b will refer to portions common in function.

The slide member 11 comprises integrally formed two slide plates 41*b* and one crossplate 42*b*. This slide member 11 is different from the slide member 4 in the position of the crossplate relative to the two slide members. That is, in the slide member 11, the crossplate 42*b* is disposed adjacent to the substantially middle portions of the slide plates 41*b*. Projections 43*b*, 44*b* are naturally provided as predetermined.

A modification of the slide member 9 of the clip 6 will be now described below.

Figure 12:
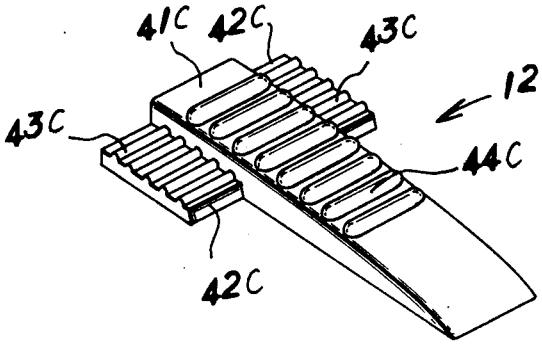
FIG. 12 is a perspective view of a modified embodiment of a slide member of the clip of FIG. 6.
Figure 6:
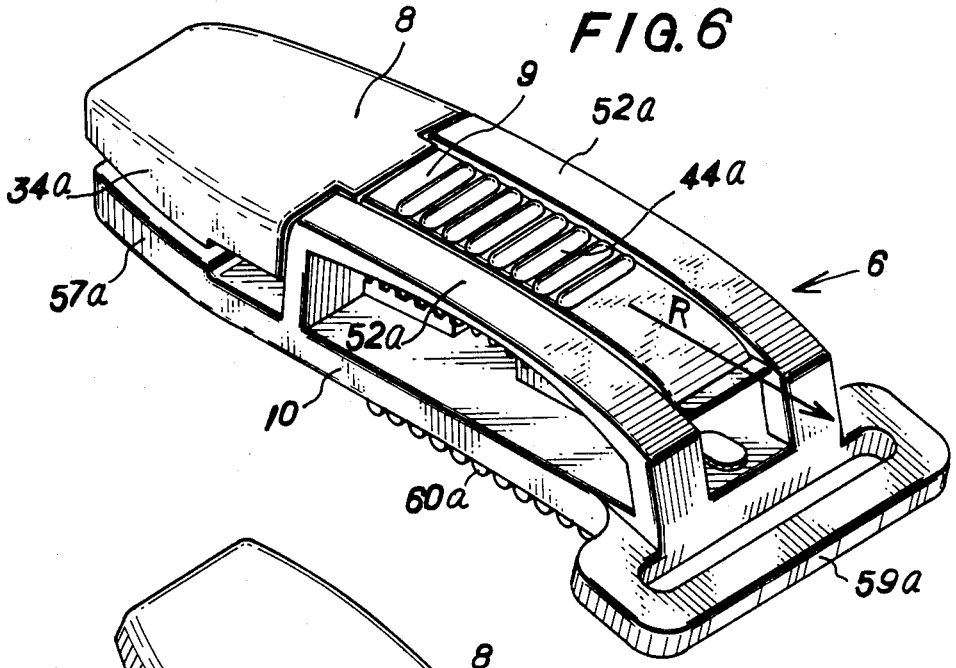
FIG. 6 is a perspective view of another embodiment of a clip according to the present invention in closed position.
Figure 7:
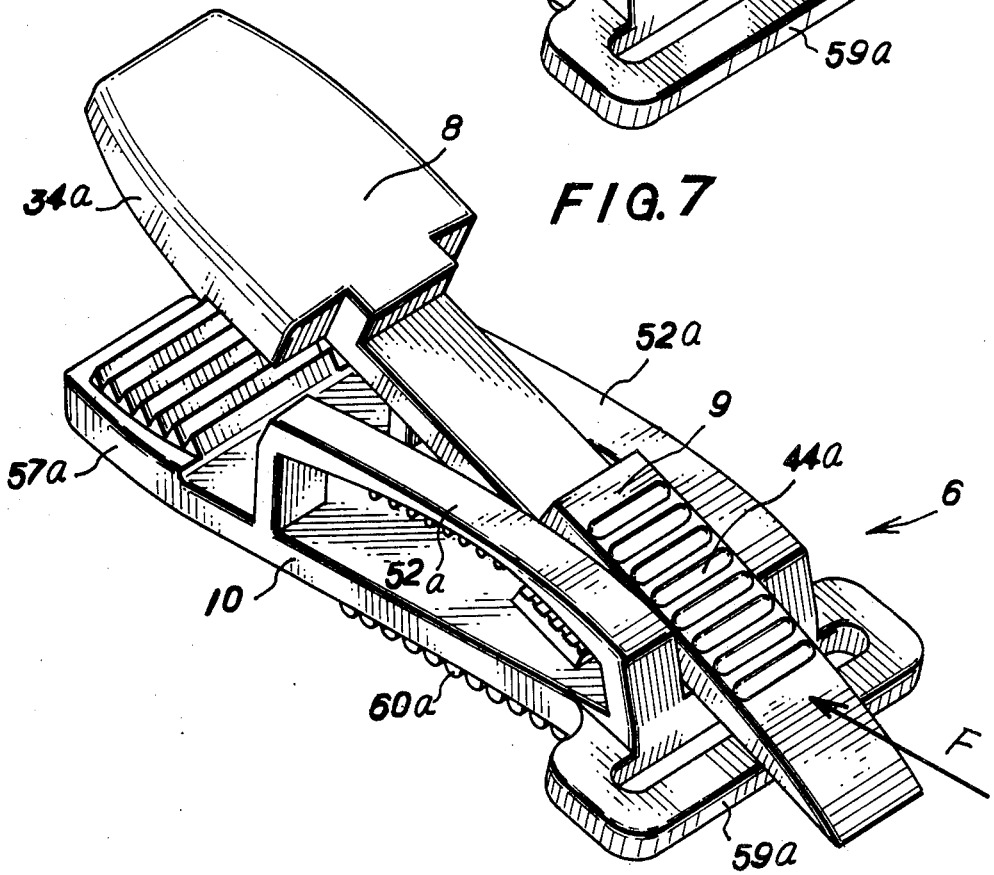
FIG. 7 is a perspective view of the clip of FIG. 6 in open position.
Figure 8:
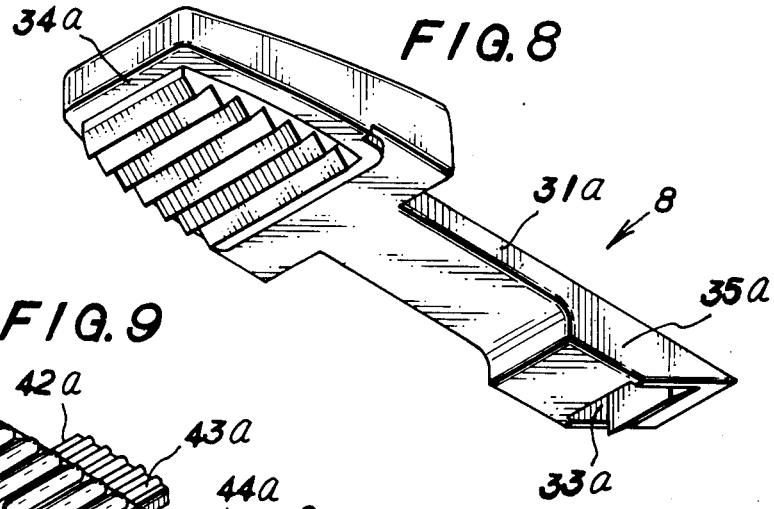
FIG. 8 is a perspective view of an upper member of the clip of FIG. 6.
Figure 9:
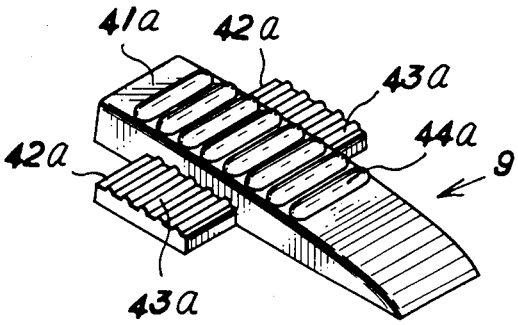
FIG. 9 is a perspective view of a slide member of the clip of FIG. 6.

Referring to FIG. 12, the same reference numerals as used relative to the slide member 9 but with annexation c will refer to portions common in function. The slide member 12 comprises integrally formed one slide plate 41*c* and two crossplates 42*c*. The slide member 12 is different from the slide member 9 in the position of the slide plate relative to the two crossplates. That is, in the slide member 12, the two crossplates 42*c* are disposed at both sides of the front end portion of the slide plate 41*c*. Projections 43*c*, 44*c* are naturally provided as predetermined.

What is claimed is:

1. A clip comprising a lower member which includes a base plate, at least one bridge consisting of two legs protruding beyond said base plate and formed integrally therewith and an elongated portion extending between said two legs, and at least one pivot projection formed integrally with said base plate and positioned at the rear portion thereof; an upper member which includes a base plate and at least one bearing portion formed integrally with said base plate and positioned to receive said pivot projection; and a slide member which includes at least one slide plate and at least one crossplate formed integrally with said slide plate so as to slidably engage with the underside of said elongated portion of said bridge; wherein at least one of the opposite rear end portions of said upper and lower members are gradually reduced in thickness toward its rear edge so that clipping sections may be kept in open position at a desired angle.

2. A clip as claimed in claim 1, wherein said upper member includes said base plate, said bearing portion and a cutaway portion for loose insertion of said bridge, and wherein said slide member comprises two slide plates and a crossplate.

3. A clip as claimed in claim 1, wherein said two bridges of said lower member are disposed at each side longitudinally of said base plate thereof, wherein said base plate of said upper member is loosely inserted between said bridges, and wherein said slide member comprises at least one slide plate and two crossplates.

4. A clip as claimed in claim 1, wherein said crossplate is provided on its upper surface with projections.

5. A clip as claimed in claim 1, wherein said elongated portion is provided on its lower surface with projections.

6. A clip as claimed in claim 1, wherein said elongated portion is formed so as to become thicker from its rear edge toward its front edge.

* * * * *